US010579000B2

(12) United States Patent
Murakami

(10) Patent No.: US 10,579,000 B2
(45) Date of Patent: Mar. 3, 2020

(54) FIXING MEMBER, FIXING APPARATUS, AND IMAGE FORMING APPARATUS

(71) Applicant: KONICA MINOLTA, INC., Chiyoda-ku, Tokyo (JP)

(72) Inventor: Masanori Murakami, Toyohashi (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 16/026,471

(22) Filed: Jul. 3, 2018

(65) Prior Publication Data

US 2019/0018349 A1 Jan. 17, 2019

(30) Foreign Application Priority Data

Jul. 13, 2017 (JP) ..... 2017-137003

(51) Int. Cl.
*G03G 15/20* (2006.01)

(52) U.S. Cl.
CPC ..... *G03G 15/206* (2013.01)

(58) Field of Classification Search
CPC ..... G03G 15/2057; G03G 15/2053; G03G 15/162; G03G 15/206; G03G 2215/2016; G03G 2215/2009; G03G 15/0105
See application file for complete search history.

(56) References Cited

U.S. PATENT DOCUMENTS

| | | | | |
|---|---|---|---|---|
| 9,423,741 | B1 * | 8/2016 | Kimura | G03G 15/206 |
| 2003/0127173 | A1 * | 7/2003 | Kamiya | G03G 15/2057 156/64 |
| 2013/0149439 | A1 * | 6/2013 | Ujihara | G03G 15/2057 427/123 |
| 2016/0274511 | A1 * | 9/2016 | Ogino | G03G 15/2053 |

FOREIGN PATENT DOCUMENTS

| | | | |
|---|---|---|---|
| JP | 2001-159418 | A | 6/2001 |
| JP | 2002-006662 | A | 1/2002 |
| JP | 2003-255733 | A | 9/2003 |
| JP | 2005-024725 | A | 1/2005 |
| JP | 2014-153659 | A | 8/2014 |

* cited by examiner

*Primary Examiner* — Walter L Lindsay, Jr.
*Assistant Examiner* — Jessica L Eley
(74) *Attorney, Agent, or Firm* — Buchanan Ingersoll & Rooney PC

(57) ABSTRACT

A fixing member comes in contact with a recording material, and the fixing member includes: an inner layer; an outer layer; and a graphite layer provided between the inner layer and the outer layer, wherein the graphite layer is bonded to at least any one of the inner layer and the outer layer, and a surface of the graphite layer to be bonded to the at least any one of the layers is ozone-treated.

19 Claims, 14 Drawing Sheets

FIG. 14

| SAMPLE | CONTACT ANGLE (deg.) | ADHESIVENESS |
|---|---|---|
| SAMPLE SP1 (NO UV EMISSION) | 90 | UNACCEPTABLE |
| SAMPLE SP2 (UV EMISSION FOR 10 MINUTES) | 70 | ACCEPTABLE |
| SAMPLE SP3 (UV EMISSION FOR 30 MINUTES) | 10 | ACCEPTABLE |

FIXING MEMBER, FIXING APPARATUS, AND IMAGE FORMING APPARATUS

The entire disclosure of Japanese patent Application No. 2017-137003, filed on Jul. 13, 2017, is incorporated herein by reference in its entirety.

BACKGROUND

Technological Field

The present invention relates to a fixing member, a fixing apparatus, and an image forming apparatus. More specifically, the present invention relates to a fixing member, a fixing apparatus, and an image forming apparatus capable of enhancing durability.

Description of the Related art

An electrophotographic image forming apparatus includes: a multi function peripheral (MFP) having a scanner function, a facsimile function, a copying function, a printer function, a data communication function, and a server function; a facsimile machine; a copying machine; and a printer.

An image forming apparatus generally forms an image on a sheet by the following method. An image forming apparatus forms an electrostatic latent image on an image carrier and develops the electrostatic latent image using a developing device to form a toner image. Next, the image forming apparatus transfers the toner image to the sheet, and fixes the toner image onto the sheet by the fixing apparatus. In addition, a certain image forming apparatus forms a toner image on a photoconductor, transfers the toner image to an intermediate transfer belt using a primary transfer roller, and performs secondary transfer of the toner image on the intermediate transfer belt onto a sheet using a secondary transfer roller.

In recent years, in order to achieve energy saving of the image forming apparatus, there is a demand for reduction in the heat capacity of the fixing apparatus. With the fixing apparatus having a small heat capacity, it is possible to rapidly heat up to a target temperature at the time of warm-up while suppressing the power consumption by suppressing the preheating of the fixing apparatus at the time of standby, leading to reduction of the warm-up time.

A fixing apparatus having a small heat capacity is smaller in size and thinner than a fixing apparatus having a large heat capacity. Therefore, a fixing apparatus having a small heat capacity has few heat channels that allow heat to move between a sheet passage part and the sheet non-passage part, making it difficult to allow heat transfer on the heating member from the sheet non-passage part to the sheet passage part (heat transfer in the axial direction of the heating member). This lead to a problem that the temperature of the sheet non-passage part is likely to rise in continuous fixing of small size sheets, deteriorating fixing property and uniformity of the image.

In order to solve the above problem, techniques of enhancing thermal conductivity in the axial direction of the heating member by providing a graphite layer in the heating member are disclosed in JP 2002-6662 A, JP 2001-159418 A (JP 4166914 B2), JP 2014-153659 A, JP 2005-24725 A, and JP 2003-255733 A, for example.

JP 2002-6662 A discloses a fixing belt including a fixing belt base material layer, a fixing belt anisotropic graphite layer, and a fixing belt release layer.

JP 2001-159418 A (JP 4166914 B2) discloses a pressing member in which a crystallized graphite layer is pasted on an elastic layer with an adhesive. In this pressing member, the crystallized graphite layer is formed with a plurality of sheets, with each of the plurality of sheets being arranged on a roller-shaped pressing member spaced from each other.

JP 2014-153659 A discloses a fixing member having a base material, an elastic layer provided on the base material, and a surface layer provided on the elastic layer. At least one of the base material and the elastic layer includes a first filler having a plurality of acicular projections and a second filler having a non-acicular structure. The surface of the first filler is covered with a graphite layer.

JP 2005-24725 A discloses a fixing rotating body including a plurality of wires coated with a low thermal conductivity member around a high thermal conductivity member formed of copper wire being stacked in parallel to the axial direction of the fixing rotating body, with a layer having thermal conductivity anisotropy being arranged between the fixing rotating body base material and the surface layer.

JP 2003-255733 A discloses a fixing apparatus that allows a roller-like member having a graphite layer on an outer circumferential surface thereof to come in contact with an outer circumferential surface of the fixing member or an outer circumferential surface of the pressing member.

In a case where an adhesive is used for fixing the graphite layer as in JP 2001-159418 A (JP 4166914 B2), there is a problem of low adhesiveness of the adhesive and low durability of the fixing member. That is, the fixing member using the adhesive for fixing the graphite layer is likely to allow the graphite layer to be uplifted against the adhesive strength of the adhesive over time, leading to generation of a portion not fixed by the adhesive in the graphite layer. This leads to generation of cracks in the graphite layer starting from the unfixed portion of the graphite layer, causing a phenomenon of breakage. This phenomenon is remarkable particularly in a case where a silicone adhesive or the like is used as an adhesive.

SUMMARY

The present invention has been made to solve the above problems, and an object of the present invention is to provide a fixing member, a fixing apparatus, and an image forming apparatus capable of enhancing durability.

To achieve the abovementioned object, according to an aspect of the present invention, there is provided a fixing member that comes in contact with a recording material, and the fixing member reflecting one aspect of the present invention comprises: an inner layer; an outer layer; and a graphite layer provided between the inner layer and the outer layer, wherein the graphite layer is bonded to at least any one of the inner layer and the outer layer, and a surface of the graphite layer to be bonded to the at least any one of the layers is ozone-treated.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 14 is a chart illustrating a measurement result of a contact angle of pure water with respect to a graphite layer according to an example of the present invention.

DETAILED DESCRIPTION OF EMBODIMENTS

Figure 1:
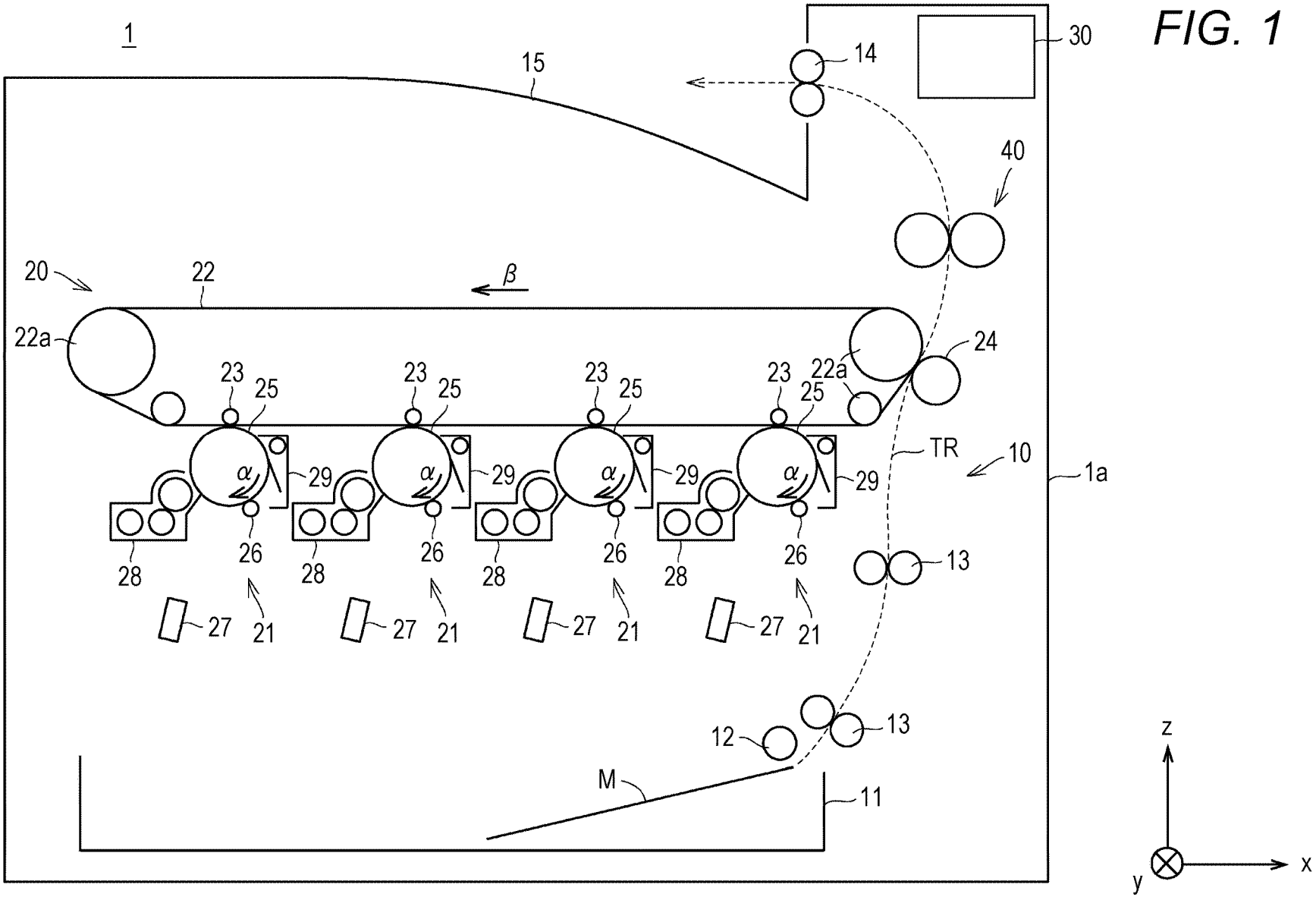
FIG. 1 is a cross-sectional view illustrating a configuration of an image forming apparatus according to a first embodiment of the present invention.

Hereinafter, one or more embodiments of the present invention will be described with reference to the drawings. However, the scope of the invention is not limited to the disclosed embodiments.

The following embodiment describes a case where the image forming apparatus on which the fixing apparatus is mounted is an MFP. The image forming apparatus on which the fixing apparatus is mounted may be a facsimile machine, a copying machine, a printer, or the like, in addition to the MFP.

[First Embodiment]

First, a configuration of an image forming apparatus according to the present embodiment will be described.

In the drawings, when an image forming apparatus 1 is viewed from the front, a width direction is defined as an x-axis direction, a depth direction is defined as a y-axis direction, and a height direction is defined as a z-axis. Each of the x-axis, the y-axis, and the z-axis is orthogonal to each other.

FIG. 1 is a cross-sectional view illustrating a configuration of the image forming apparatus 1 according to the first embodiment of the present invention.

With reference to FIG. 1, the image forming apparatus 1 according to the present embodiment is an MFP, and mainly includes a sheet conveyer 10, a toner image forming part 20, a controller 30, and a fixing apparatus 40.

The sheet conveyer 10 includes a sheet feed tray 11, a sheet feed roller 12, a plurality of conveyance rollers 13, a sheet discharge roller 14, and a sheet discharge tray 15. The sheet feed tray 11 accommodates sheets M (exemplary recording material) for forming an image. A plurality of the sheet feed trays 11 may be provided. The sheet feed roller 12 is arranged between the sheet feed tray 11 and a conveyance path TR. Each of the plurality of conveyance rollers 13 is arranged along the conveyance path TR. The sheet discharge roller 14 is provided at the most downstream portion of the conveyance path TR. The sheet discharge tray 15 is provided at the uppermost portion of an image forming apparatus main body 1*a*.

The toner image forming part 20 combines images of four colors of yellow (Y), magenta (M), cyan (C), and black (K) by a tandem system to form a toner image on the sheet M. The toner image forming part 20 includes an image forming unit 21 for each of colors of Y, M, C, and K, an intermediate transfer belt 22, a primary transfer roller 23 for each of colors of Y, M, C, and K, and a secondary transfer roller 24.

The image forming unit 21 for each of the colors of Y, M, C, and K includes a photoconductive drum 25, a charging roller 26, an exposure apparatus 27, a developing apparatus 28, and a cleaning apparatus 29. The photoconductive drum 25 is rotationally driven in a direction indicated by an arrow α in FIG. 1. The photoconductive drum 25 is surrounded by the charging roller 26, the developing apparatus 28, and the cleaning apparatus 29. The charging roller 26 is provided in proximity to the photoconductive dram 25. The exposure apparatus 27 is provided under the photoconductive drum 25.

The intermediate transfer belt 22 is provided above the image forming units 21 of individual colors of Y, M, C, and K. The intermediate transfer belt 22 is annular, and is disposed across a rotating roller 22*a*. The intermediate transfer belt 22 is rotationally driven in a direction indicated by an arrow β in FIG. 1. Each of the primary transfer rollers 23 faces each of the photoconductive drums 25 with the intermediate transfer belt 22 interposed therebetween. The secondary transfer roller 24 is in contact with the intermediate transfer belt 22 in the conveyance path TR.

The controller 30 includes a central processing unit (CPU), a read only memory (ROM), and a random access memory (RAM), and controls entire operation of the image forming apparatus 1.

The fixing apparatus 40 conveys a sheet carrying a toner image along the conveyance path TR while gripping the sheet so as to fix the toner image onto the sheet M.

The image forming apparatus 1 rotates the photoconductive drum 25 to charge the surface of the photoconductive drum 25 with the charging roller 26. The image forming apparatus 1 allows the exposure apparatus 27 to perform exposure onto the surface of the charged photoconductive drum 25 in accordance with image formation information so as to form an electrostatic latent image on the surface of the photoconductive drum 25.

Next, the image forming apparatus 1 supplies toner from the developing apparatus 28 to the photoconductive drum 25 on which an electrostatic latent image is formed, and then performs development so as to form a toner image on the surface of the photoconductive drum 25.

Next, the image forming apparatus 1 uses the primary transfer roller 23 to sequentially transfer the toner image formed on the photoconductive drum 25 to the surface of the intermediate transfer belt 22 (primary transfer). In the case of a full-color image, a toner image obtained by combining toner images of individual colors of Y, M, C, and K is formed on the surface of the intermediate transfer belt 22.

The image forming apparatus 1 uses the cleaning apparatus 29 to remove the toner remaining on the photoconductive drum 25 without being transferred to the intermediate transfer belt 22.

Subsequently, the image forming apparatus 1 uses the rotating roller 22*a* to convey the toner image formed on the surface of the intermediate transfer belt 22 to a position facing the secondary transfer roller 24.

Meanwhile, the image forming apparatus 1 uses the sheet feed roller 12 to feed the sheet M accommodated in the sheet feed tray 11, and uses each of the plurality of conveyance rollers 13 to guide the sheet M to a portion between the intermediate transfer belt 22 and the secondary transfer roller 24 along the conveyance path TR. Then, the image forming apparatus 1 uses the secondary transfer roller 24 to transfer the toner image formed on the surface of the intermediate transfer belt 22 to the sheet M.

The image forming apparatus 1 guides the sheet M onto which the toner image is transferred to the fixing apparatus 40, and fixes the toner image onto the sheet M by the fixing apparatus 40. Thereafter, the image forming apparatus 1 uses the sheet discharge roller 14 to discharge the sheet M on which the toner image has been fixed to the sheet discharge tray 15.

Figure 2:
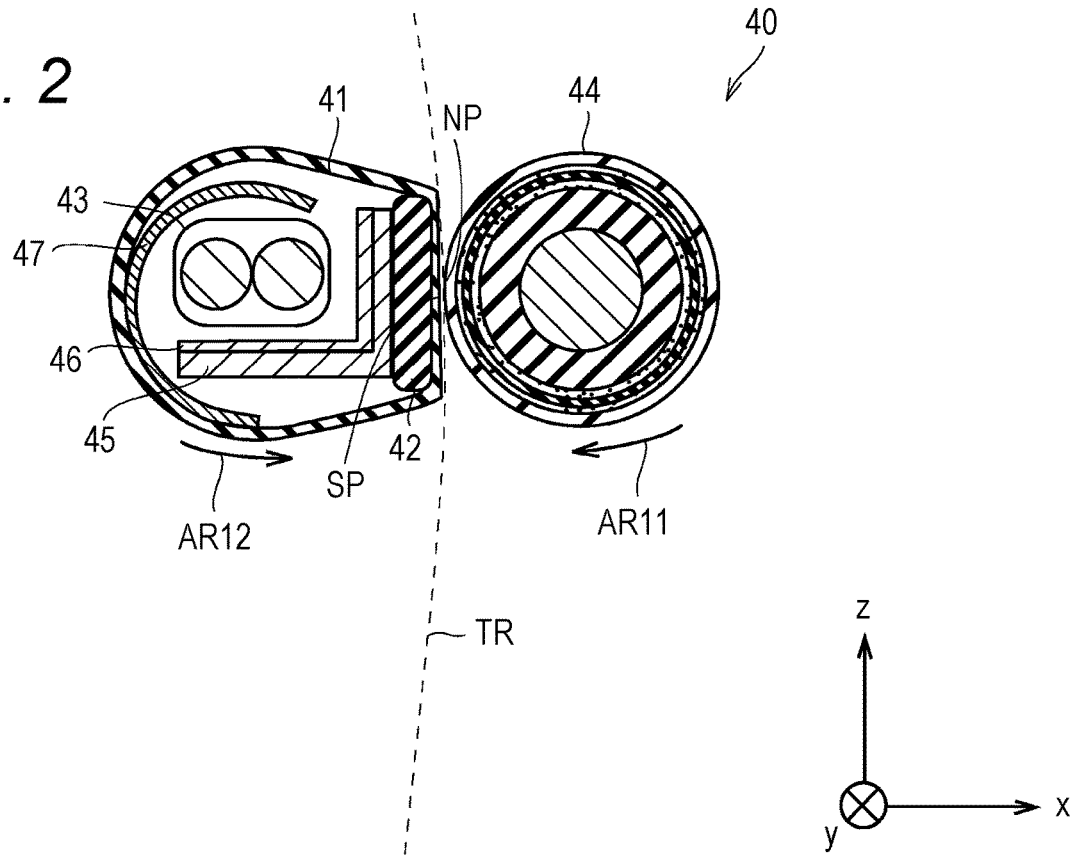
FIG. 2 is a cross-sectional view illustrating a configuration of a fixing apparatus according to the first embodiment of the present invention.

FIG. 2 is a cross-sectional view illustrating a configuration of the fixing apparatus 40 according to the first embodiment of the present invention.

With reference to FIG. 2, the fixing apparatus 40 allows the sheet M to pass through a fixing nip NP from the upstream side to the downstream side of the conveyance path TR, so as to fix the toner image onto the sheet M. The fixing apparatus 40 includes a fixing belt 41, a pad 42, a heater 43, a pressure roller 44 (exemplary fixing member), a pad frame (support member) 45, a reflecting member 46, and a guide member 47. The fixing apparatus 40 allows the sheet M through the fixing nip NP between the fixing belt 41 and the pressure roller 44 to apply heat and pressing force to the sheet M from the fixing belt 41 so as to fix the toner image onto the sheet M.

The fixing belt 41 is an endless belt that fixes the image onto the sheet M. The fixing belt 41 is nipped by guide members (side plates) (not illustrated) at both ends in the axial direction so as to be in pressing contact with the pressure roller 44 and supported at a position where the fixing nip NP is formed. The material of the fixing belt 41 is determined in consideration of heat resistance, strength, surface smoothness, or the like. The fixing belt 41 includes, for example, a base layer formed of a PI base material (polyimide) having a thickness of 60 μm, an elastic layer formed of rubber having a thickness of 200 μm provided on the outer diameter side of the PI base material, and a release layer formed of a fluororesin (PFA) tube having a thickness of 30 μm provided on the outer diameter side of the elastic layer. The fixing belt 41 has a diameter of 25 mm, for example.

The pad 42 is provided inside the fixing belt 41. The pad 42 extends in parallel to the extending direction of the rotation axis of the fixing belt 41. The pad 42 presses the fixing belt 41 against the pressure roller 44 from the inside. The pad 42 is formed of a liquid crystal polymer, for example.

The heater 43 is provided inside the fixing belt 41. The heater 43 extends in parallel to the extending direction of the rotation axis of the fixing belt 41. The heater 43 heats the fixing belt 41 to a predetermined target temperature. The heater 43 is a dual heater mutually different in light distribution, specifically including a long heater emitting full-width light (heating the entire rotation axis direction of the fixing belt 41) and a short heater emitting light at a central portion (heating a center portion in the rotation axis direction of the fixing belt 41). The heater 43 is a halogen heater and has a pipe diameter of 5.5 mm, for example.

The pressure roller 44 is provided at a position facing the pad 42 via the fixing belt 41. The pressure roller 44 applies pressure to the surface of the heated rotating body (in this case, the fixing belt 41). The pressure roller 44 is in pressing contact with the fixing belt 41, and forms the fixing nip NP coming in contact with the sheet between the pressure roller 44 and the fixing belt 41. The pressure roller 44 is rotationally driven in a direction indicated by an arrow AR11 by a drive motor (not illustrated). The fixing belt 41 is a free belt driven by the rotation of the pressure roller 44 and rotates in a direction indicated by an arrow AR12.

The pad frame 45 is provided inside the fixing belt 41. The pad frame 45 extends in parallel to the extending direction of the rotation axis of the fixing belt 41. The pad frame 45 holds the pad 42. The pad frame 45 is formed by bending an electrogalvanized steel plate (SECC) having a thickness of 2.0 mm, for example.

The reflecting member 46 is fixed to the surface of the pad frame 45 on the side facing the heater 43. The reflecting member 46 reflects the heat of the heater 43. This makes it possible to effectively utilize radiant heat from the heater 43 for heating the fixing belt 41. The reflecting member 46 is formed of a reflective plate (sheet) formed of aluminum having a thickness of 0.5 mm, for example.

The guide member 47 is in contact with a portion of the inner circumferential surface of the fixing belt 41 and guides the rotation of the fixing belt 41.

Each of the rotation axis direction of the fixing belt 41, the longitudinal direction of the pad 42, and the rotation axis R direction of the pressure roller 44 is parallel to the y-axis.

A temperature sensor (not illustrated) for measuring the temperature of the fixing apparatus 40 is arranged at the central portion of the fixing belt 41 in the rotation axis direction. The controller 30 controls lighting of the heater 43 so as to set the fixing apparatus 40 to have a predetermined fixing temperature (for example, a range of 150 to 180 degrees) on the basis of the temperature measured by the temperature sensor.

Figure 3:
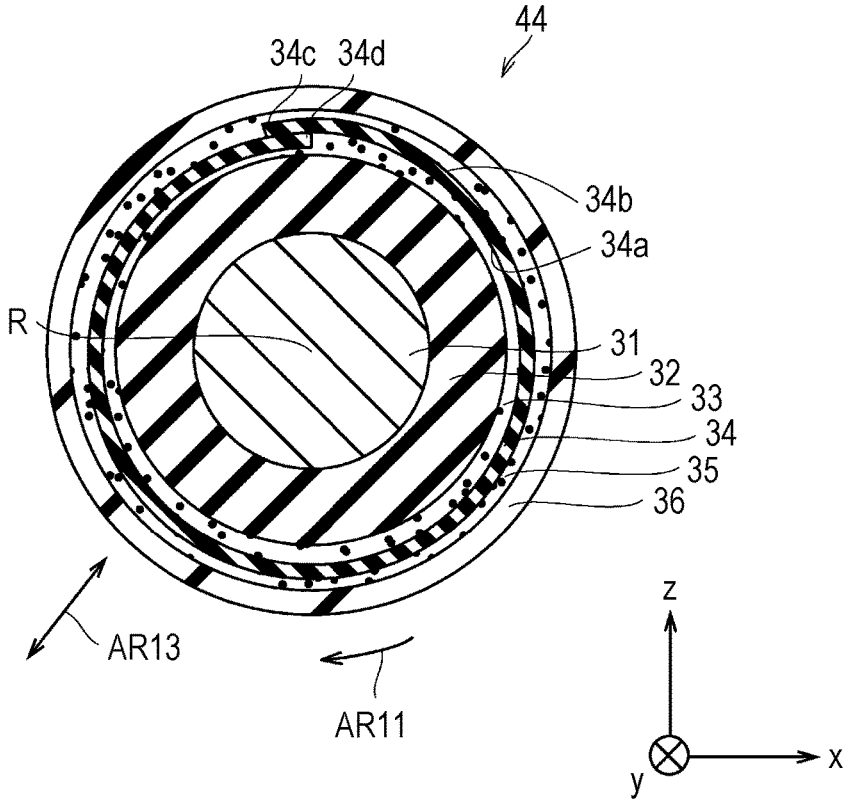
FIG. 3 is a cross-sectional view illustrating a configuration of a pressure roller according to the first embodiment of the present invention.

FIG. 3 is a cross-sectional view illustrating a configuration of the pressure roller 44 according to the first embodiment of the present invention. An arrow AR13 in FIG. 3 indicates a radial direction of the pressure roller 44 (direction concentrically away from a rotation axis R of the pressure roller 44 when the rotation axis R is defined as a starting point).

With reference to FIG. 3, the pressure roller 44 applies pressure to the surface of the heated rotating body (here, the fixing belt 41). The pressure roller 44 has a cylindrical shape, and includes a base layer (core metal) 31, an elastic layer 32 (exemplary inner layer), an adhesive layer 33, a graphite layer 34, an adhesive layer 35, and a release layer 36 (exemplary outer layer). The pressure roller 44 has a diameter of 25 mm, for example, and the thickness of a portion excluding the base layer 31 is 3 mm, for example.

The base layer 31 has a solid cylindrical shape (tubular shape). Each of the elastic layer 32, the graphite layer 34, and the release layer 36 has a hollow cylindrical shape (tubular shape). The elastic layer 32 is provided on the outer diameter side (outer side) of the base layer 31 and is in contact with the outer circumferential surface of the base layer 31. The graphite layer 34 is provided on the outer diameter side of the elastic layer 32. The release layer 36 is provided on the outer diameter side (outer side) of the graphite layer 34. In other words, the graphite layer 34 is provided between the elastic layer 32 and the release layer 36. The graphite layer 34 may cover at least a portion of the outer circumferential surface of the elastic layer 32.

The elastic layer 32 is preferably a sponge layer. With the elastic layer 32 formed as a sponge layer, it is possible to reduce the bending stress on the graphite layer 34, leading to enhancement of the durability of the graphite layer 34. In addition, the elastic layer 32 formed as a sponge layer makes it possible to enhance the heat insulating property, enabling the heat applied to the pressure roller 44 from the fixing belt 41 to be retained on the outer circumferential surface of the pressure roller 44. This result in enhancement of the fixing efficiency and suppression of power consumption of the fixing apparatus 40.

The graphite layer 34 is adhered to each of the elastic layer 32 and the release layer 36. That is, the inner circumferential surface 34*a* of the graphite layer 34 is bonded to the elastic layer 32 by the adhesive layer 33. The outer circumferential surface 34*b* of the graphite layer 34 is bonded to the release layer 36 by the adhesive layer 35.

The thickness of the graphite layer 34 in the radial direction is preferably greater than the thickness in the radial direction of the adhesive layer 35. For example, the thickness in the radial direction of the graphite layer 34 is 40 μm, and the thickness in the radial direction of the adhesive layer 35 is 30 μm. Thinning of the adhesive layer 35 makes it possible to promote thermal conduction from the release layer 36 to the graphite layer 34.

Examples of the graphite layer 34 include a graphite sheet such as PGS (registered trademark) graphite sheet (manufactured by Panasonic Corporation) or Graphinity (manufactured by Kaneka Corporation). The thickness of the graphite layer 34 is preferably 10 μm to 150 μm, and most preferably 40 μm.

Each of the adhesive layers 33 and 35 is preferably formed of an adhesive capable of bonding a silicone rubber. Examples of these include a one-component room temperature vulcanizing (RTV) silicone rubber adhesive (manufactured by Shin-Etsu Chemical Co., Ltd.). The thickness of each of the adhesive layers 33 and 35 is preferably 5 μm to 35 μm, most preferably 30 μm.

Each of the inner circumferential surface 34*a* and the outer circumferential surface 34*b* as the surface to be bonded to the elastic layer 32 or the release layer 36 in the graphite layer 34 is ozone-treated. As a result of the ozone treatment, carbon (C) atoms at the outermost surfaces of the inner circumferential surface 34*a* and the outer circumferential surface 34*b* are bound to the oxygen (O) atoms of the ozone, and the outermost surface of each of the inner circumferential surface 34*a* and the outer circumferential surface 34*b* has formation of functional groups such as "C—O". Whether the surface of the graphite layer is ozone-treated can be judged by measuring the oxygen content near the surface of the graphite layer using X-ray photoelectric spectroscopy (XPS) or the like.

Note that it is allowable to have a configuration of FIG. 3 in which the inner circumferential surface 34*a* of the graphite layer 34 is bonded to the elastic layer 32 and is ozone-treated, and the outer circumferential surface 34*b* of the graphite layer 34 is bonded to the release layer 36 and is not ozone-treated. In this case, the adhesive layer 35 between the outer circumferential surface 34*b* of the graphite layer 34 and the release layer 36 may have weak adhesive strength to such an extent capable of preventing deviation of the graphite layer 34 in the rotation axis R direction (partial application on the outer circumferential surface 34*b*).

Moreover, it is allowable to have a configuration of FIG. 3 in which the inner circumferential surface 34*a* of the graphite layer 34 is bonded to the elastic layer 32 and is not ozone-treated, and the outer circumferential surface 34*b* of the graphite layer 34 is bonded to the release layer 36 and ozone-treated. In this case, the adhesive layer 33 between the inner circumferential surface 34*a* of the graphite layer 34 and the elastic layer 32 may have weak adhesive strength to such an extent capable of preventing deviation of the graphite layer 34 in the rotation axis R direction (partial application on the inner circumferential surface 34*a*).

The pressure roller 44 in the present embodiment is prepared by the following method.

The elastic layer 32 is provided on the outer circumferential surface of the base layer 31, an adhesive is applied to the outer circumferential surface of the elastic layer 32, and the ozone-treated graphite sheet is wound around it. Next, an adhesive is applied to the outer circumferential surface of the graphite sheet to provide the release layer 36. Subsequently, the adhesive is baked and cured at a temperature of 200 to 250 degrees. With this procedure, the adhesive layer 33, the graphite layer 34, and the adhesive layer 35 are formed between the elastic layer 32 and the release layer 36, so as to obtain the pressure roller 44.

Figure 4A:
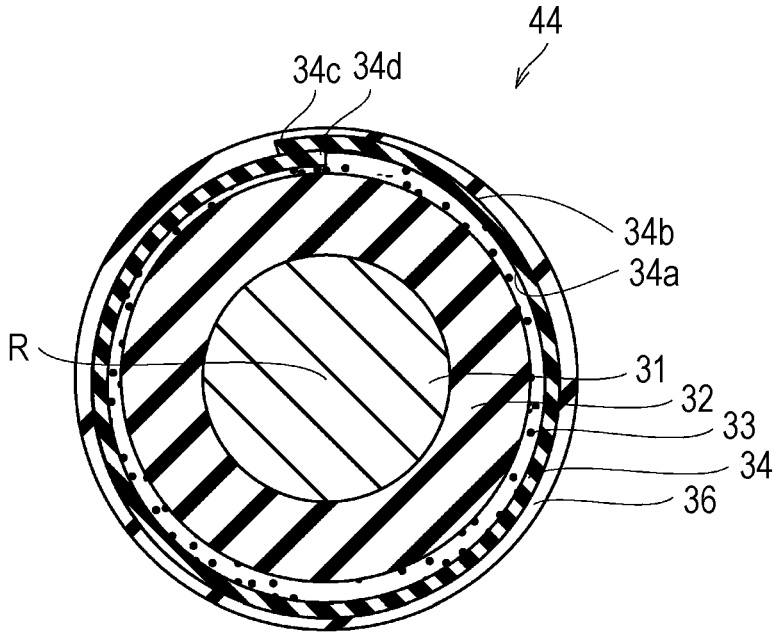
FIGS. 4A and 4B are cross-sectional views illustrating a configuration of a modification of the pressure roller according to the first embodiment of the present invention.
Figure 4B:
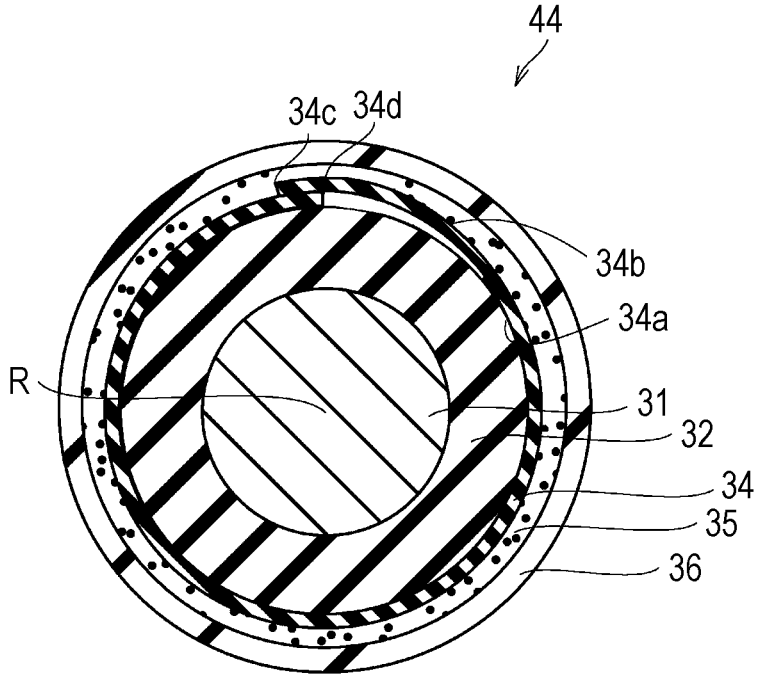

FIGS. 4A and 4B are cross-sectional views illustrating a configuration of a modification of the pressure roller 44 according to the first embodiment of the present invention. FIG. 4A illustrates a configuration of a first modification, and FIG. 4B illustrates a configuration of a second modification.

With reference to FIGS. 4A and 4B, it is sufficient that the graphite layer 34 be adhered to at least any one of the elastic layer 32 and the release layer 36, and the bonded surface of the graphite layer 34 be ozone-treated. As a modification of the present embodiment, as illustrated in FIG. 4A, it is sufficient that the ozone-treated inner circumferential surface 34*a* of the graphite layer 34 be adhered to the elastic layer 32 by the adhesive layer 33, and the outer circumferential surface 34*b* of the graphite layer 34 be not adhered to the release layer 36. In this case, whether to perform ozone treatment on the outer circumferential surface 34*b* is optional. As illustrated in FIG. 4B, it is sufficient that the ozone-treated outer circumferential surface 34*b* of the graphite layer 34 be adhered to the release layer 36 by the adhesive layer 35, and the inner circumferential surface 34*a* of the graphite layer 34 be not adhered to the elastic layer 32. In this case, whether to perform ozone treatment on the inner circumferential surface 34*a* is optional.

According to the present embodiment, the surface to be bonded in the graphite layer 34 is ozone-treated, and functional groups with high hydrophilicity such as "C—O" are formed on the surface to be bonded in the graphite layer 34. This increases the compatibility between the graphite layer 34 and the adhesive, leading to enhancement of the adhesiveness and durability of the graphite layer 34.

In addition, in a case where both the inner circumferential surface 34*a* and the outer circumferential surface 34*b* of the graphite layer 34 is ozone-treated and bonded, it is possible to firmly fix the graphite layer 34 to both the elastic layer 32 and the release layer 36, leading to achievement of stable durability of the graphite layer 34.

In addition, since graphite is a material having high thermal conductivity, with the pressure roller 44 including the graphite layer 34, it is possible to promote thermal conduction in the rotation axis R direction (y-axis direction) of the pressure roller 44. As a result, even when the heat accumulation is increased at the sheet non-passage part (end in the rotation axis R direction of the pressure roller 44) in a case where a sheet having a small sheet passing width is passed through the fixing apparatus 40, it is possible to promote heat transmission from the sheet non-passage part to the outside, leading to suppression of the temperature rise in the sheet non-passage part.

In a case where the inner circumferential surface 34*a* of the graphite layer 34 is ozone-treated and bonded as in the first modification, the graphite layer 34 is firmly fixed to the elastic layer 32 side. In consideration of the fact that the elastic layer 32 side is more deformed than the release layer 36 side and is likely to be displaced from the graphite layer 34, the first modification is effective in suppressing displacement of the graphite layer 34 due to deformation of the elastic layer 32. In addition, it is possible to reduce the time needed for ozone treatment as compared with the case where ozone treatment is performed on both the inner circumferential surface 34*a* and the outer circumferential surface 34*b* of the graphite layer 34.

In a case where the outer circumferential surface 34*b* of the graphite layer 34 is ozone-treated and bonded as in the second modification, the graphite layer 34 is firmly fixed to the release layer 36 side, leading to enhanced adhesion between the graphite layer 34 and the release layer 36. This enhances thermal conductivity from the surface of the pressure roller 44 to the graphite layer 34 and effectively suppresses the temperature rise at the end in the rotation axis R direction of the pressure roller 44. In addition, it is possible to reduce the time needed for ozone treatment as compared with the case where ozone treatment is performed on both the inner circumferential surface 34*a* and the outer circumferential surface 34*b* of the graphite layer 34.

[Second Embodiment]

While the fixing member according to an embodiment of the present invention is highly effective when applied to a pressure roller as in the first embodiment, the fixing member may also be applied to a fixing member other than the pressure roller, on the fixing apparatus, such as a fixing belt, a fixing roller, or a pressure belt. In the present embodiment, a case where the fixing member of the present invention is applied to a fixing belt will be described.

Figure 5:
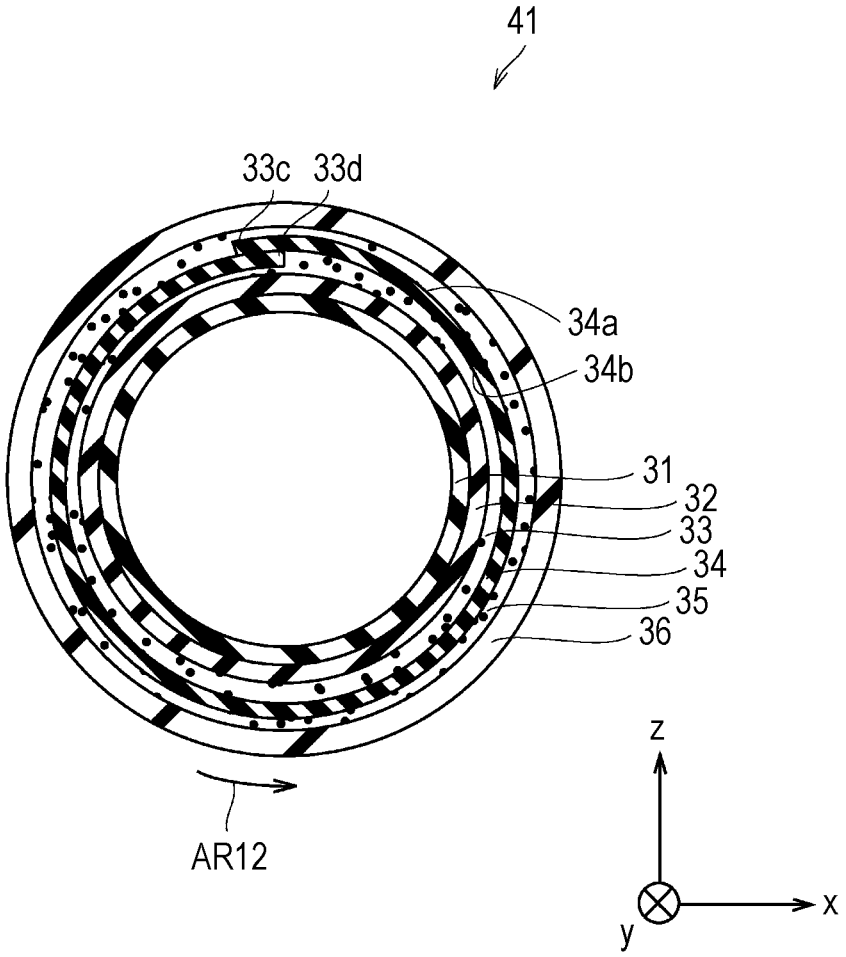
FIG. 5 is a cross-sectional view illustrating a configuration of a fixing belt according to a second embodiment of the present invention.

FIG. 5 is a cross-sectional view illustrating a configuration of the fixing belt 41 according to the second embodiment of the present invention. In FIG. 5, the thickness of the fixing belt 41 is emphasized more than the actual thickness of the fixing belt 41.

With reference to FIG. 5, the fixing belt 41 includes the base layer 31, the elastic layer 32, the adhesive layer 33, the graphite layer 34, the adhesive layer 35, and the release layer 36. The base layer 31 is formed of a polyimide material, a metal material such as nickel or stainless steel (SUS), and has a hollow cylindrical shape (tubular shape).

The configuration of the fixing belt 41 other than the above is similar to the case of the pressure roller 44 of the first embodiment illustrated in FIG. 3, and thus, description thereof will not be repeated.

According to the present embodiment, it is possible to obtain effects similar to the case of the first embodiment.

[Third Embodiment]

In the present embodiment, a method of forming the graphite layer 34 in the pressure roller 44 of the first embodiment illustrated in FIG. 3 will be described.

FIGS. 6 to 12 are diagrams illustrating a method of forming the graphite layer 34 according to the third embodiment of the present invention.

Figure 6:
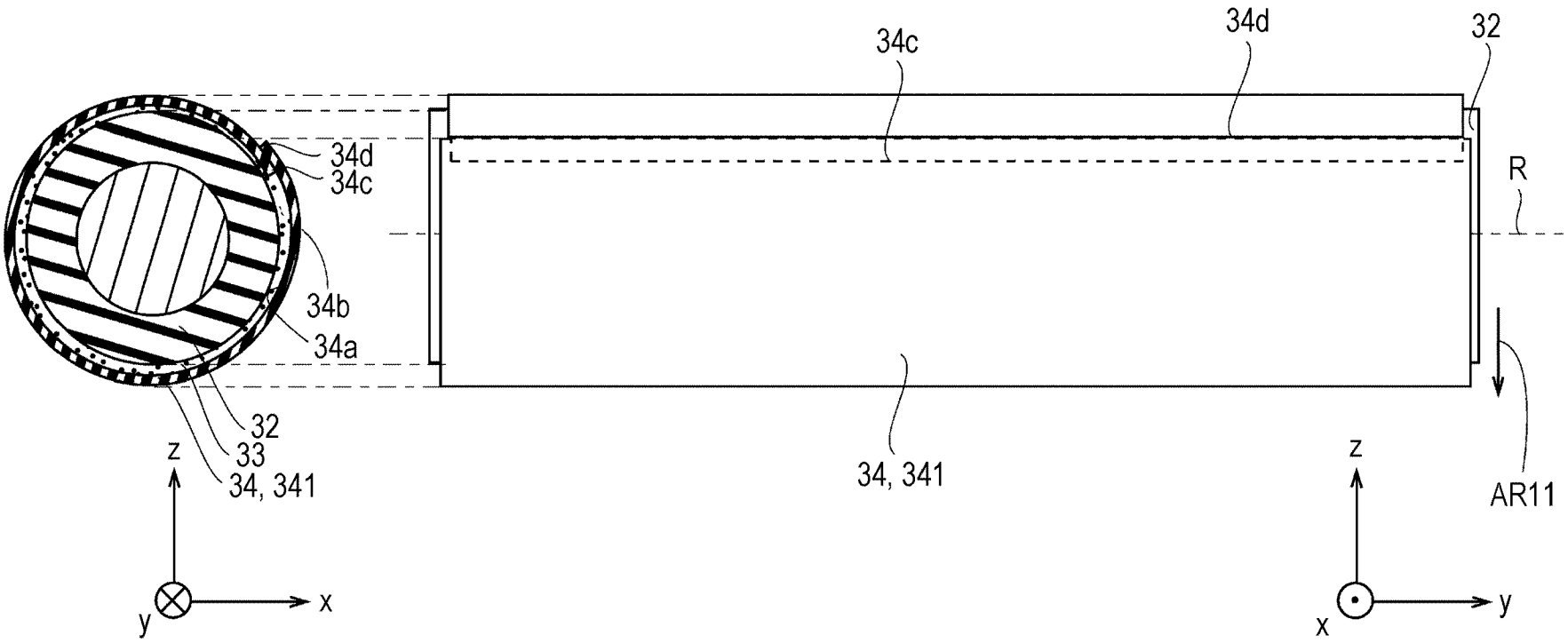
FIG. 6 is a diagram illustrating a first forming method of a graphite layer according to a third embodiment of the present invention.

With reference to FIG. 6, in a first forming method, a graphite sheet 341 constituting the graphite layer 34 has a width in the rotation axis direction substantially equal to the width of the elastic layer 32 in the rotation axis R direction, while having a length in the rotational direction equal to or longer than the length of the rotational direction indicated by the arrow AR11 of the elastic layer 32 (hereinafter also referred to as the rotational direction). The graphite sheet 341 is wound around the outer circumferential surface of the elastic layer 32 along the rotational direction via the adhesive layer 33. A starting end 34*c* as a starting position of winding of the graphite sheet 341 overlaps with a finishing end 34*d* as a finishing position of winding of the graphite sheet 341. It is preferable that the portions where the graphite sheets 341 overlap each other are bonded to each other by an adhesive in order to enhance the durability of the graphite layer 34.

With a configuration of overlapping the starting end 34*c* and the finishing end 34*d* of the graphite sheet 341 with each other, it is possible to relax the dimensional tolerance of the length in the rotational direction needed for the graphite sheet 341 constituting the graphite layer 34, leading to facilitation of manufacturing. This also increases the coverage of the graphite layer 34 on the outer circumferential surface of the elastic layer 32, making it possible to enhance the heat transfer rate in the rotation axis R direction of the pressure roller 44.

Note that the starting end 34*c* and the finishing end 34*d* of the graphite sheet 341 need not overlap each other. This would reduce the likelihood of generation of a step on the surface of the pressure roller 44. This would also reduce the amount of graphite sheet used, making it possible to reduce the manufacturing cost. In a case where the starting end 34*c* and the finishing end 34*d* of the graphite sheet 341 are provided so as not to overlap with each other, it is allowable to use the adhesive layer to fill the step of the boundary portion between an exposed portion of the elastic layer 32 and the graphite sheet 341 so as to prevent generation of a step on the surface of the pressure roller 44.

Figure 7:
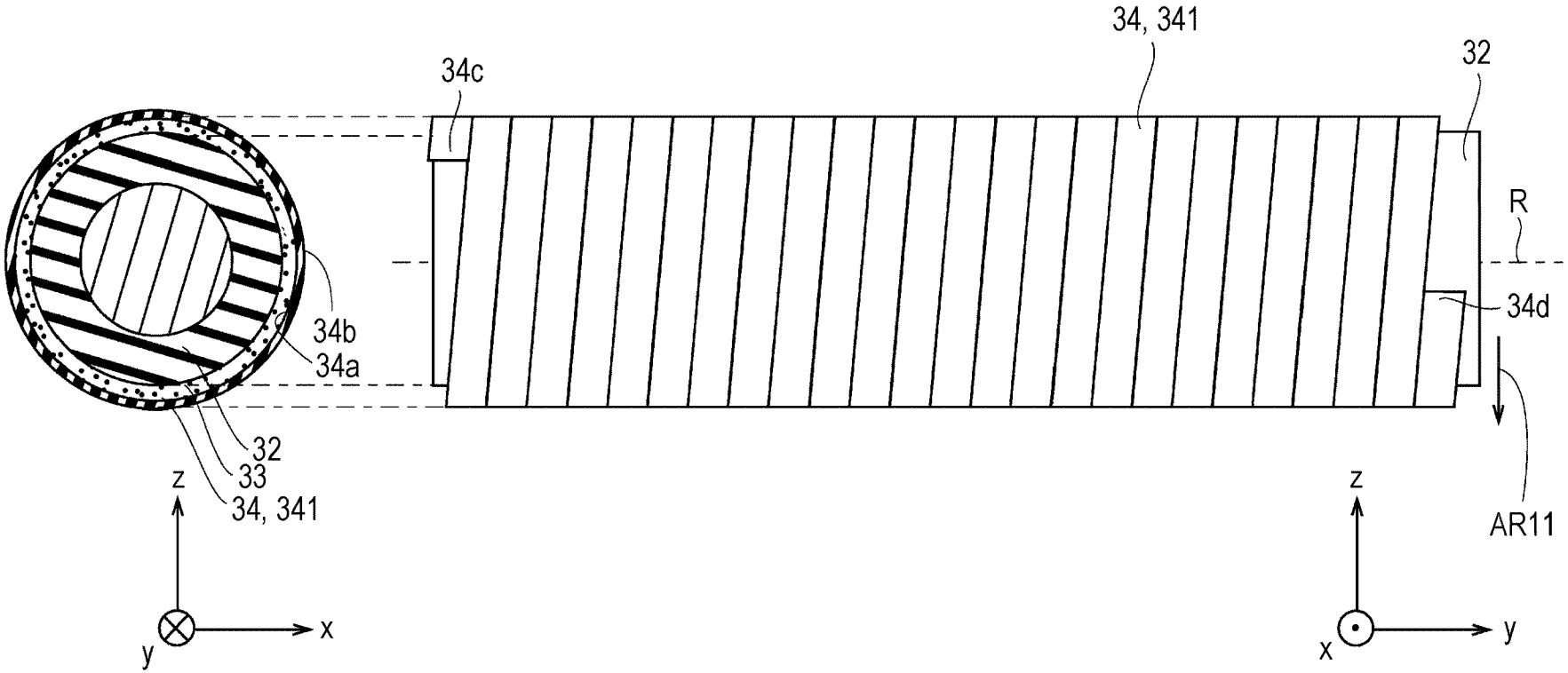
FIG. 7 is a diagram illustrating a second forming method of the graphite layer according to the third embodiment of the present invention.

With reference to FIG. 7, in a second forming method, the graphite sheet 341 constituting the graphite layer 34 has a width in the rotation axis R direction sufficiently shorter than the width of the elastic layer 32 in the rotation axis R direction, while having a length in the rotational direction sufficiently longer than the length of the rotational direction of the elastic layer 32. The graphite sheet 341 is spirally wound around the rotation axis R via the adhesive layer 33 with respect to the outer circumferential surface of the elastic layer 32. The graphite sheet 341 is wound around the outer circumferential surface of the elastic layer 32 without spacing in the rotation axis R direction.

Since the typical thickness of the graphite sheet is as very thin as about 40 μm, wrinkles tend to occur in winding the graphite sheet 341. The wrinkles occurring in the graphite sheet 341 would generate irregularities on the surface of the pressure roller 44, leading to uneven fixing property of the fixing apparatus 40. According to the second forming method, since the graphite sheet 341 can be wound with tension applied to the graphite sheet 341, wrinkles are less likely to occur in the graphite sheet 341. This leads to equalization of the fixing property of the fixing apparatus 40.

Figure 8:
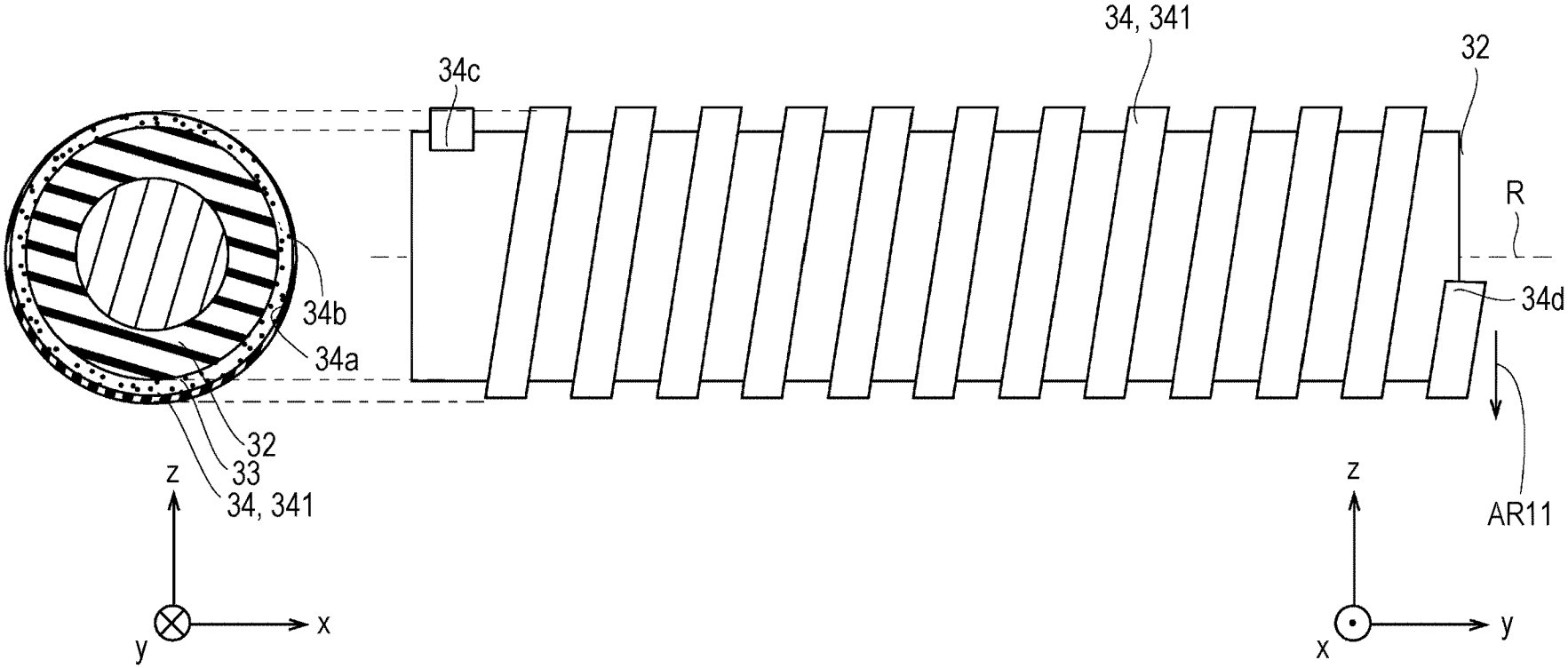
FIG. 8 is a diagram illustrating a modification of the second forming method of the graphite layer according to the third embodiment of the present invention.

With reference to FIG. 8, in the second forming method, the graphite sheet 341 constituting the graphite layer 34 may be wound around the outer circumferential surface of the elastic layer 32 spaced from each other in the rotation axis R direction. This also reduces the amount of graphite sheet used, making it possible to reduce the manufacturing cost. It is also allowable to use the adhesive layer to fill the step of the boundary portion between the exposed portion of the elastic layer 32 and the graphite sheet 341 so as to prevent generation of a step on the surface of the pressure roller 44.

Figure 9:
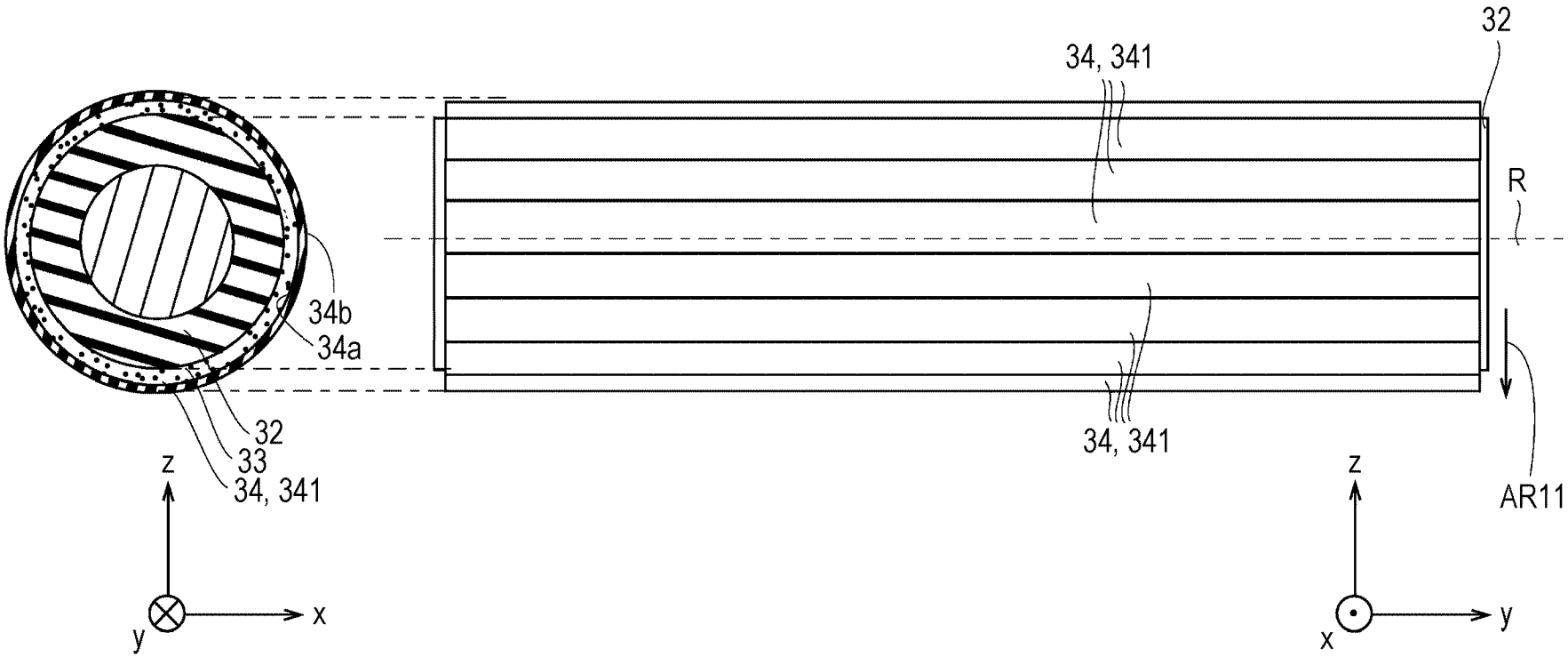
FIG. 9 is a diagram illustrating a third forming method of the graphite layer according to the third embodiment of the present invention.

With reference to FIG. 9, a third forming method uses a plurality of graphite sheets constituting the graphite layer 34. Each of the plurality of graphite sheets 341 has a width in the rotation axis R direction substantially equal to the width of the elastic layer 32 in the rotation axis R direction, while having a length in the rotational direction sufficiently shorter than the length of the rotational direction of the elastic layer 32. Each of the plurality of graphite sheets 341 is pasted to the outer circumferential surface of the elastic layer 32 via the adhesive layer 33 so as to extend along the rotation axis R of the pressure roller 44. Each of the plurality of graphite sheets 341 is arranged without spacing along the rotational direction.

With arrangement of each of the plurality of graphite sheets 341 along the rotational direction, it is possible to release the force in the rotational direction received by the graphite layer 34 from the elastic layer 32 due to the difference in the thermal expansion coefficient between the elastic layer 32 and the graphite layer 34.

Figure 10:
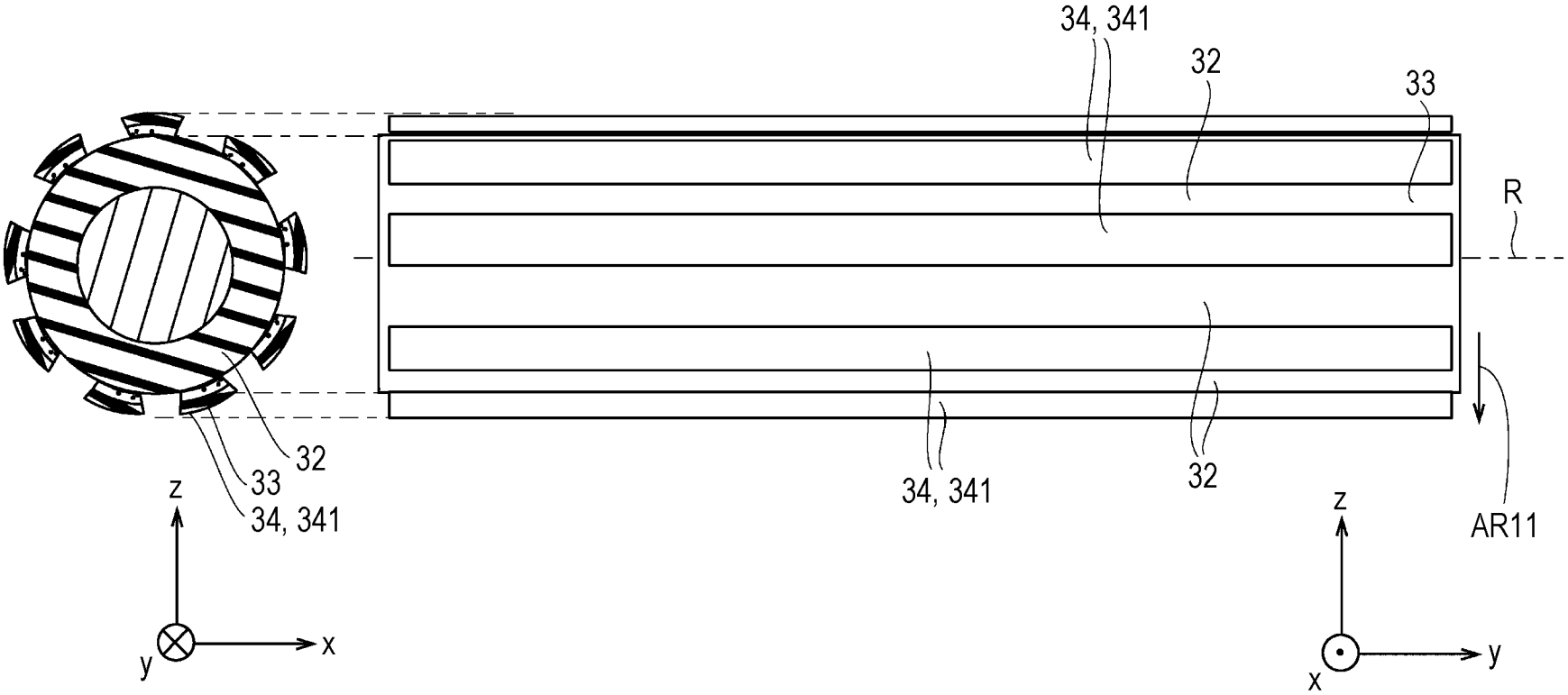
FIG. 10 is a diagram illustrating a modification of the third forming method of the graphite layer according to the third embodiment of the present invention.

With reference to FIG. 10, in the third forming method, each of the plurality of graphite sheets 341 may be pasted to the outer circumferential surface of the elastic layer 32 spaced from each other in the rotational direction. This can reduce the amount of graphite sheet used, making it possible to reduce the manufacturing cost. It is also allowable to use the adhesive layer to fill the step of the boundary portion between the exposed portion of the elastic layer 32 and the graphite sheet 341 so as to prevent generation of a step on the surface of the pressure roller 44.

Figure 11:
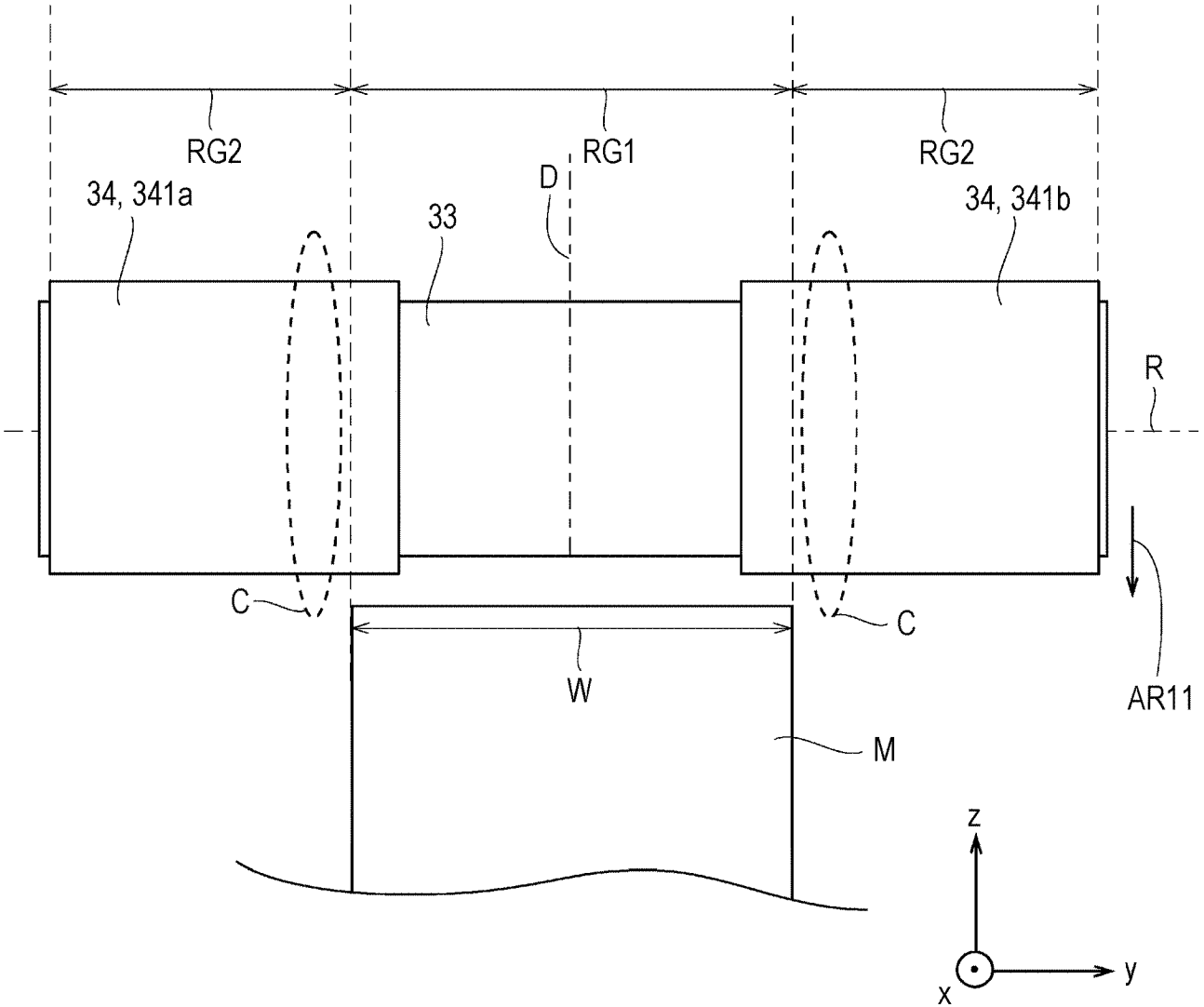
FIG. 11 is a diagram illustrating a fourth forming method of the graphite layer according to the third embodiment of the present invention.

With reference to FIG. 11, in a fourth forming method, the graphite layer 34 includes two graphite sheets 341*a* and 341*b* (examples of first and second graphite pieces). Each of the graphite sheets 341*a* and 341*b* has a width in the rotation axis R direction being half the width of the elastic layer 32 in the rotation axis R direction or less, and has a length substantially equal to the length in the rotational direction of the elastic layer 32. The graphite sheet 341*a* is wound around the outer circumferential surface of the elastic layer 32 via the adhesive layer 33 at one end side (left end side in FIG. 11) in the rotation axis R direction. The graphite sheet 341*b* is wound around the outer circumferential surface of the elastic layer 32 via the adhesive layer 33 at the other end side (right end side in FIG. 11) in the rotation axis R direction. The graphite sheet 341*b* is spaced from the graphite sheet 341*a* in the rotation axis R direction, with the elastic layer 32 exposed between the graphite sheet 341*a* and the graphite sheet 341*b*. It is allowable to use the adhesive layer to fill the step of the boundary portion between the exposed portion of the elastic layer 32 and each of the graphite sheets 341*a* and 341*b* so as to prevent generation of a step on the surface of the pressure roller 44.

Herein, a sheet passage part of the pressure roller 44 when the smallest passable sheet M passes through the fixing apparatus 40 is defined as a sheet passage part RG1, while a sheet non-passage part of the pressure roller 44 when the smallest passable sheet M passes through the fixing apparatus 40 is defined as a sheet non-passage part RG2. The portion of the pressure roller 44 having the highest temperature when the sheet M passes through the fixing apparatus 40 is a portion (indicated by C in FIG. 11) of the sheet non-passage part RG2, near the boundary with the sheet passage part RG1.

Therefore, as illustrated in FIG. 11, each of the graphite sheets 341*a* and 341*b* extends from a portion of the sheet non-passage part RG2, near the boundary with the sheet passage part RG1 toward the end, making it possible to efficiently release the heat at the portion having the highest temperature to the end.

For example, when the sheet M is A6 size (width 105 mm in rotation axis R direction), it is preferable to provide the graphite sheets 341*a* and 341*b* in the range of 50 mm to 149 mm distance from the center line D in the rotation axis R direction of the pressure roller 44. It is more preferable to provide the graphite sheets 341*a* and 341*b* in the range from a portion at 50 mm distance from the center line D to the end of the pressure roller 44.

With each of the graphite sheets 341*a* and 341*b* provided with spacing in the rotation axis R direction of the pressure roller 44, it is possible to reduce the use amount of graphite sheet and thus reduce the manufacturing cost.

Figure 12:
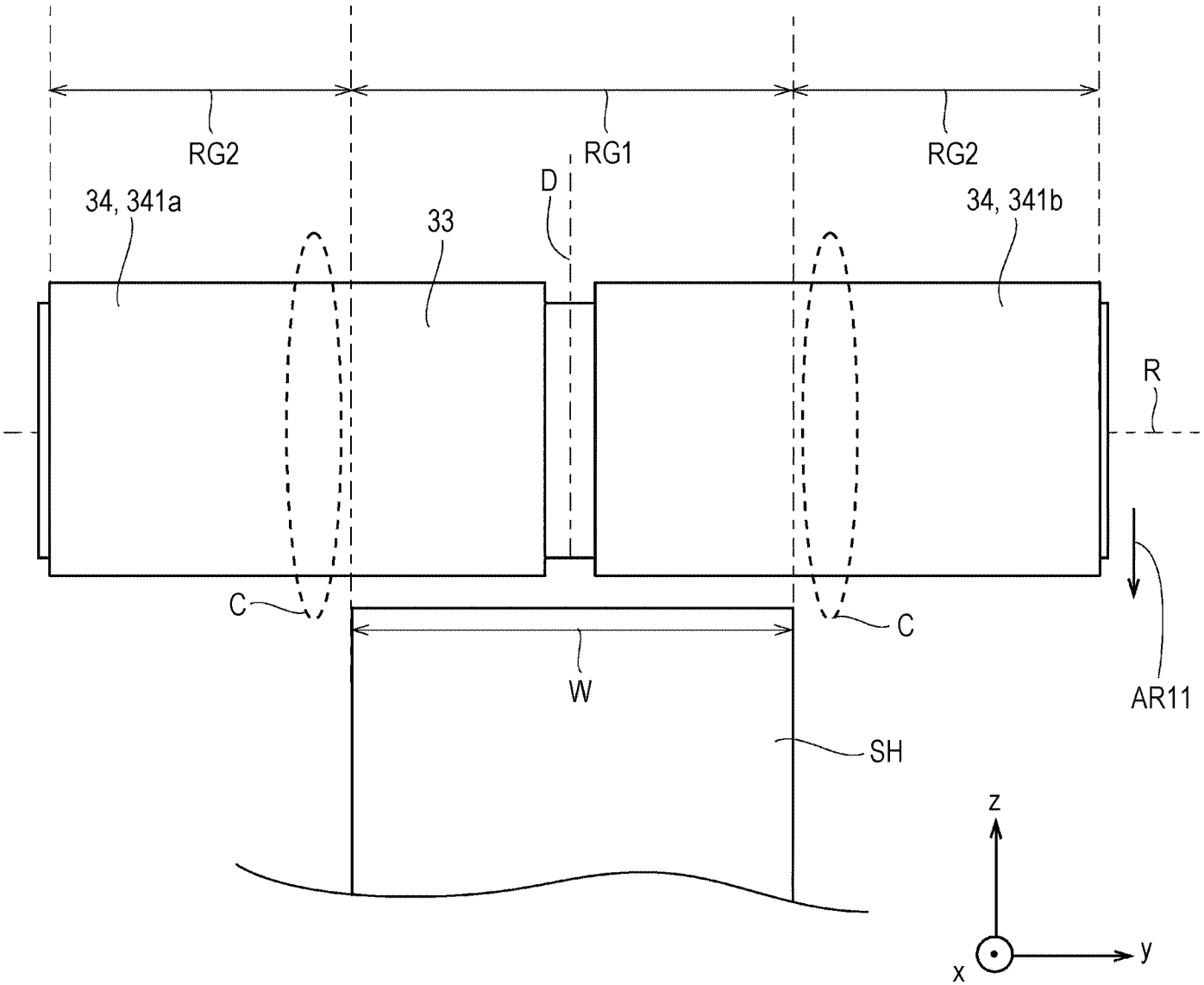
FIG. 12 is a diagram illustrating a modification of the fourth forming method of the graphite layer according to the third embodiment of the present invention.

With reference to FIG. 12, in the fourth forming method, each of the graphite sheets 341*a* and 341*b* may further extend from the portion of the sheet non-passage part RG2, near the boundary with the sheet passage part RG1, toward a center line D in the rotation axis R direction. With this configuration, it is possible to release the heat of the portion having the highest temperature also to the center line D side, leading to suppression of the temperature rise of the sheet non-passage part RG2 more effectively.

[Fourth Embodiment]

The present embodiment will describe a configuration of releasing the heat of the graphite layer 34 to the base layer 31 so as to effectively suppress the temperature rise of the sheet non-passage part of the pressure roller 44.

Figure 13A:
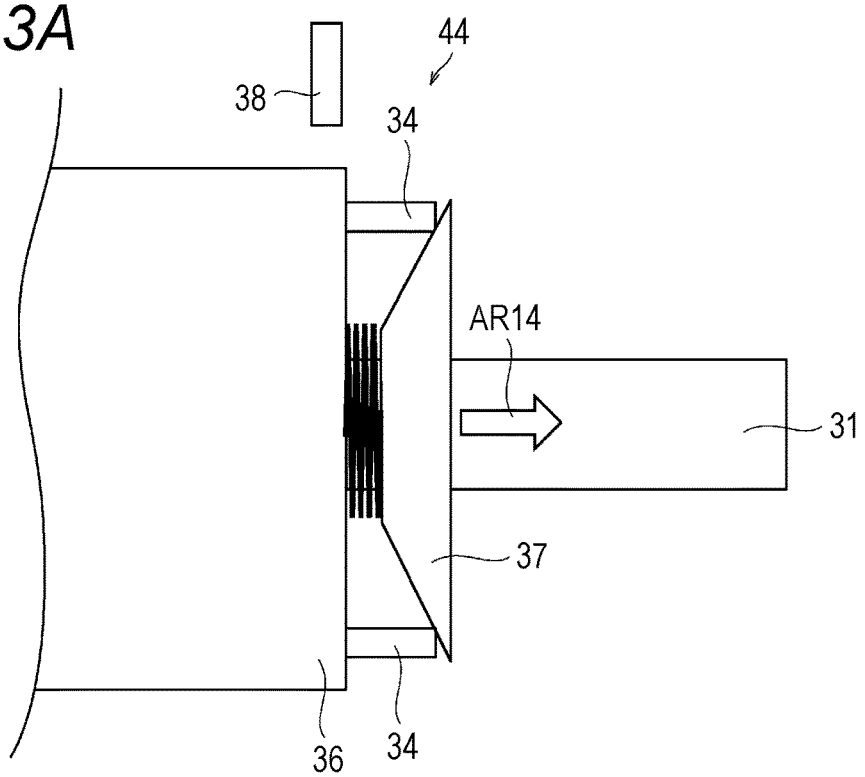
FIGS. 13A and 13B are diagrams illustrating a configuration and operation of a heat transfer member provided at one end of the pressure roller according to the fourth embodiment of the present invention.
Figure 13B:
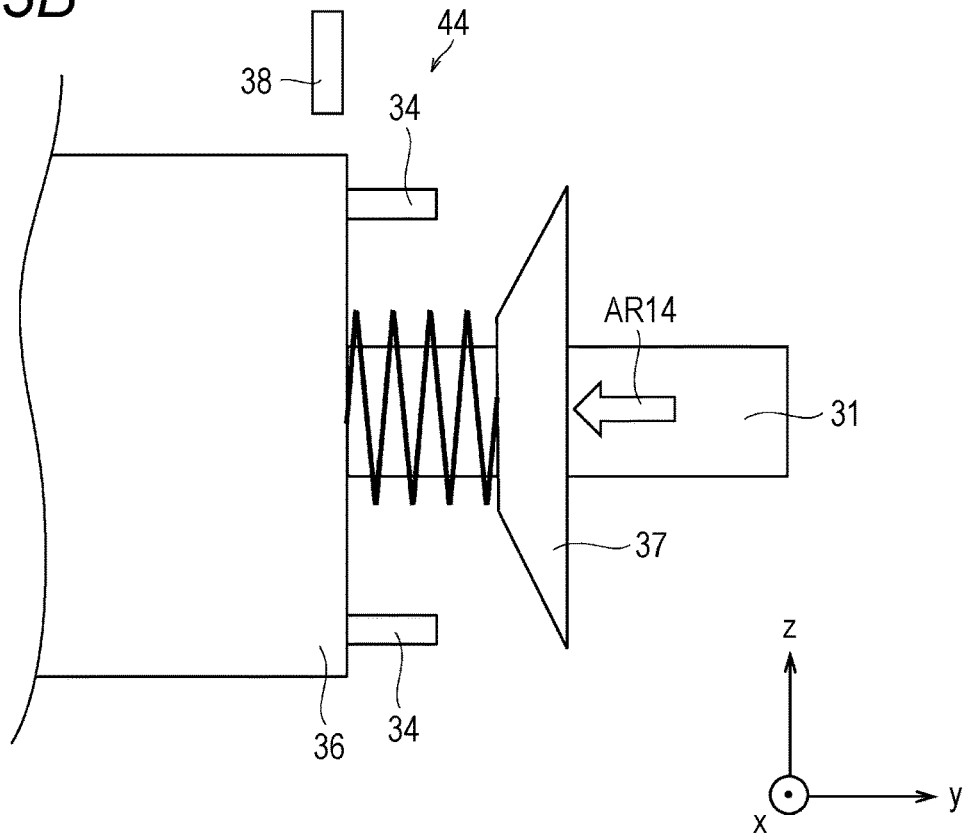

FIGS. 13A and 13B are diagrams illustrating a configuration and operation of a heat transfer member 37 provided at one end of the pressure roller 44 according to the fourth embodiment of the present invention. FIG. 13A is a diagram illustrating a first state of the heat transfer member 37. FIG. 13B is a diagram illustrating a second state of the heat transfer member 37.

With reference to FIGS. 13A and 13B, the pressure roller 44 of the present embodiment further includes the heat transfer member 37. The heat transfer member 37 is formed of a metal such as iron. The heat transfer member 37 is preferably formed of a material such as copper or aluminum having a thermal conductivity higher than that of iron.

Each of the base layer 31 and the graphite layer 34 protrudes from the end of the pressure roller 44 in the rotation axis R direction. The heat transfer member 37 is constantly in contact with the base layer 31 and is movable along the base layer 31 as indicated by an arrow AR14. This configuration makes it possible to switch the state of the heat transfer member 37 between a state of being in contact with the graphite layer 34 as illustrated in FIG. 13A and a state of being separated from the graphite layer 34 as illustrated in FIG. 13B.

In a case where the temperature rise in the sheet non-passage part at passage of a sheet having a size smaller than a predetermined size, or the like, can be predicted, the heat transfer member 37 is kept in contact with the graphite layer 34 at least for a certain period of time (FIG. 13A). In a state where the heat transfer member 37 is in contact with the graphite layer 34, the heat of the graphite layer 34 is released to the base layer 31 via the heat transfer member 37.

In contrast, when there is a need to heat the surface of the pressure roller 44 at the time of warm-up of the fixing apparatus 40, or the like, the heat transfer member 37 is separated from the graphite layer 34 (FIG. 13B). This makes it possible to prevent heat on the surface of the pressure roller 44 from escaping to the base layer 31 via the graphite layer 34 and the heat transfer member 37, leading to achievement of maintaining rapid warm-up operation.

It is also allowable to provide a temperature sensor 38 near the sheet non-passage part on the surface of the pressure roller 44, so as to set the heat transfer member 37 to be separated from the graphite layer 34 by default (FIG. 13B), and set the heat transfer member 37 to be in contact with the graphite layer 34 (FIG. 13A) in a case where the temperature of the sheet non-passage part measured by the temperature sensor 38 becomes a threshold or more.

The heat transfer member 37 may be any member as long as it can switch between the state of being in contact with the base layer 31 and the graphite layer 34, and a state of being separated from at least one of the base layer 31 and the graphite layer 34.

According to the present embodiment, the heat of the graphite layer 34 can be released to the base layer 31 via the heat transfer member 37, making it possible to effectively suppress the temperature rise of the sheet non-passage part.

EXAMPLES

In order to confirm effects of the above embodiment, the inventors of the present invention conducted the following experiment. First, effects of ozone treatment on the graphite layer were verified.

A light source using a low pressure mercury lamp was arranged at a distance of 80 mm from the surface of the graphite layer and ultraviolet rays are emitted from the light source toward the surface of the graphite layer through the air. With this configuration, ozone treatment was performed on the surface of the graphite layer. The light source used was an UV/ozone surface processing unit PL17-110E (manufactured by SEN LIGHTS Corporation, ultraviolet wavelength: 184.9 nm and 253.7 nm, power consumption: 110 W). Three patterns of ultraviolet ray emission times of 0 (no emission), 10 minutes, and 30 minutes were respectively set as Sample SP1 (comparative example), Sample SP2 (example of the present invention), and Sample SP3 (example of the present Invention). Subsequently, pure water was applied onto the surface of the ozone-treated graphite layer for each of Sample SP1, Sample SP2, and Sample SP3, and the contact angles of pure water with respect to the graphite layer were measured.

FIG. 14 is a chart illustrating a measurement result of the contact angles of pure water with respect to the graphite layer according to an example of the present invention.

With reference to FIG. 14, the contact angle of pure water with respect to the surface of Sample SP1 being a graphite layer not irradiated with ultraviolet rays was 90°. In contrast, the contact angle of the sample SP2 being a graphite layer irradiated with ultraviolet rays for 10 minutes is 70°, while the contact angle of the sample SP3 being the graphite layer irradiated with ultraviolet rays for 30 minutes is 10°.

Subsequently, a pressure roller was prepared using each of Sample SP1, Sample SP2, and Sample SP3, and the pressure roller was rotated in the fixing apparatus incorporating the prepared pressure roller.

As a result, it was confirmed in Sample SP1 that the graphite layer was uplifted from the adhesive layer at a point where the pressure roller was rotated for 30 minutes, and breakage of the graphite layer was confirmed at a point where the pressure roller was rotated for two hours. In contrast, in each of Sample SP2 and Sample SP3 having a contact angle of 70° or more, uplift of the graphite layer from the adhesive layer was not observed even after the pressure roller was rotated for 500 hours. The time of 500 hours is a sufficient rotation time assumed as the lifetime of the fixing apparatus.

Consequently, it was found that with the ozone treatment, it is possible to enhance the adhesiveness of the graphite layer to the adhesive, and enhance the durability of the graphite layer.

Next, effects of suppressing the temperature rise in the sheet non-passage part by the graphite layer were tested.

Prepared are Sample SP11 (example of the present invention) as a fixing apparatus incorporating a pressure roller including an ozone-treated graphite layer and Sample SP12 (comparative example) as a fixing apparatus incorporating a pressure roller not including the graphite layer. Next, for each of Sample SP11 and Sample SP12, a predetermined number of sheets (five types for Sample SP11 and three types for Sample SP12) having different sheet passing widths were passed. After passing a predetermined number of sheets, temperature measurement was performed in the pressure roller included in each of Sample SP11 and Sample SP12 to obtain the maximum temperature of the sheet non-passage part (temperature of a portion with the highest temperature in the sheet non-passage part (end in the rotation axis direction)).

Figure 15:
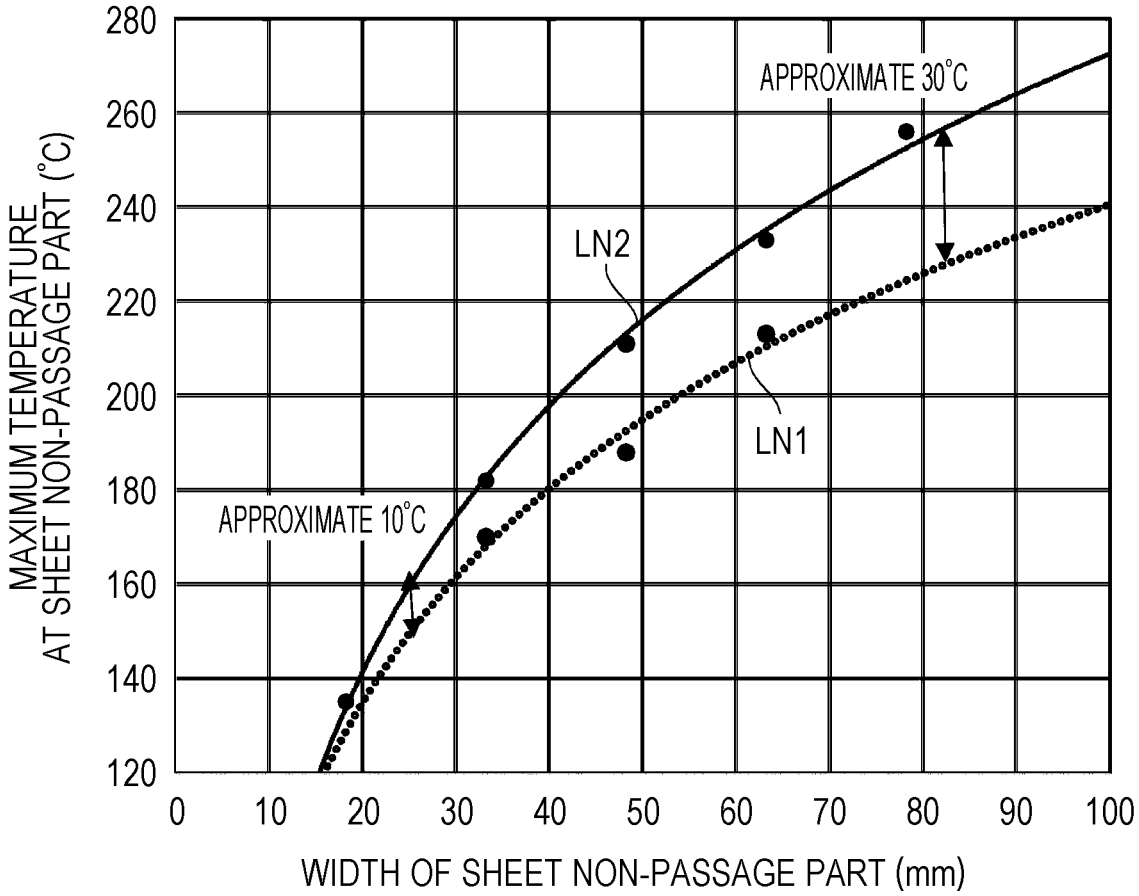
FIG. 15 is a chart illustrating a relationship between a width of a sheet non-passage part and a maximum temperature of the sheet non-passage part according to an example of the present invention.

FIG. 15 is a chart illustrating a relationship between the width of the sheet non-passage part and the maximum temperature of the sheet non-passage part according to an example of the present invention. A line LN1 in FIG. 15 illustrates a measurement result of Sample SP11, while a line LN2 in FIG. 15 illustrates a measurement result of Sample SP12.

With reference to FIG. 15, the maximum temperature of the sheet non-passage part increases in each of Sample SP11 and Sample SP12 together with the increase in the width of the sheet non-passage part (in other words, together with the decrease in the sheet passing width of the sheet to be passed). Still, the maximum temperature of the sheet non-passage part is 10 to 30 degrees lower in Sample SP11 than Sample SP12, regardless of the difference of the sheets. Moreover, the increase ratio of the maximum temperature of the sheet non-passage part to the increase in the width of the sheet non-passage part was smaller in Sample SP11 than in Sample SP12.

From this result, it can be seen that the temperature rise in the sheet non-passage part can be suppressed by the pressure roller including the graphite layer. In addition, it is observed that the effect of suppressing the temperature rise of the sheet non-passage part is remarkable especially in a case where the sheet having a small sheet passing width is passed.

[Others]

The present invention is particularly effective when applied to a fixing apparatus having a low heat capacity.

Examples of a method of changing the contact angle of the graphite layer include a method of changing the ultraviolet emission time, a method of changing the distance from the light source to the graphite layer, and a method of changing the output of the light source (mercury lamp).

Examples of ozone treatment method includes the above-described ozone treatment using ultraviolet rays, wet treatment using ozone water, and treatment with ozone alone without using ultraviolet rays.

The above-described embodiments can be combined as appropriate. For example, the configuration of the first or second modifications of the first embodiment may be applied to the fixing belt 41 of the second embodiment. Moreover, the method of forming the graphite layer 34 in the third embodiment may be applied to the fixing belt 41 of the second embodiment.

According to an embodiment of the present invention, it is possible to provide a fixing member, a fixing apparatus, and an image forming apparatus capable of enhancing durability.

Although embodiments of the present invention have been described and illustrated in detail, the disclosed embodiments are made for purposes of illustration and example only and not limitation. The scope of the present invention should be interpreted by terms of the appended claims, and is intended to include all modifications within the meaning and scope, which are equivalent to the scope of claims.

What is claimed is:

1. A fixing member that comes in contact with a recording material, the fixing member comprising:

an inner layer;

an outer layer; and a graphite layer provided between the inner layer and the outer layer, wherein the graphite layer is bonded to at least any one of the inner layer and the outer layer by an adhesive layer, a surface of the graphite layer to be bonded to the at least any one of the layers is ozone-treated, and the graphite layer comprises a graphite sheet.

2. The fixing member according to claim 1, wherein the inner layer and the outer layer are tubular in shape, the graphite layer is provided outside the inner layer, and the outer layer is provided outside the graphite layer.

3. The fixing member according to claim 2, wherein an outer circumferential surface of the graphite layer is bonded to the outer layer by the adhesive layer and is ozone-treated.

4. The fixing member according to claim 3, wherein a thickness in the radial direction of the graphite layer is greater than a thickness in the radial direction of the adhesive layer that bonds the graphite layer with the outer layer.

5. The fixing member according to claim 2, wherein an inner circumferential surface of the graphite layer is bonded to the inner layer by the adhesive layer and is ozone-treated.

6. The fixing member according to claim 1, wherein a contact angle of pure water with respect to the ozone-treated surface of the graphite layer is 70 degrees or less.

7. The fixing member according to claim 1, wherein the fixing member is a pressure roller that applies pressure to a surface of a heated rotating body.

8. The fixing member according to claim 7, wherein the inner layer includes: a base layer; and a sponge layer provided between the base layer and the graphite layer.

9. The fixing member according to claim 8, further comprising a heat transfer member capable of switching states between a state of being in contact with the base layer and the graphite layer, and a state of being separated from at least one of the base layer and the graphite layer.

10. The fixing member according to claim 9, wherein the heat transfer member is in the state of being separated at the time of warm-up, and is in the state of being in contact at least for a certain time at the time of printing.

11. The fixing member according to claim 9, wherein the heat transfer member is in the state of being separated at the time of warm-up, and is in the state of being in contact at least for a certain time at the time of passing a recording material smaller in size than a predetermined size.

12. The fixing member according to claim 1, wherein the graphite layer is wound around the inner layer along a rotational direction of the fixing member.

13. The fixing member according to claim 12, wherein the graphite layer includes: a first graphite piece provided on one end side in the rotation axis direction; and a second graphite piece provided on the other end side in the rotation axis direction, spaced from the first graphite piece in the rotation axis direction.

14. A fixing apparatus comprising the fixing member according to claim 1, wherein the fixing apparatus is adapted to fix a toner image onto the recording material.

15. An image forming apparatus comprising:

the fixing apparatus according to claim 14; and a toner image forming part that forms the toner image on the recording material.

16. A fixing member that comes in contact with a recording material, the fixing member comprising:

an inner layer;

an outer layer; and a graphite layer provided between the inner layer and the outer layer, wherein the graphite layer is bonded to at least any one of the inner layer and the outer layer by an adhesive layer, a surface of the graphite layer to be bonded to the at least any one of the layers is ozone-treated, and the graphite layer is spirally wound around a rotation axis of the fixing member.

17. A fixing apparatus comprising the fixing member according to claim 16, wherein the fixing apparatus is adapted to fix a toner image onto the recording material.

18. A fixing member that comes in contact with a recording material, the fixing member comprising:

an inner layer;

an outer layer; and a graphite layer provided between the inner layer and the outer layer, wherein the graphite layer is bonded to at least any one of the inner layer and the outer layer by an adhesive layer, a surface of the graphite layer to be bonded to the at least any one of the layers is ozone-treated, the graphite layer includes a plurality of graphite pieces arranged along a rotational direction of the fixing member, and each of the plurality of graphite pieces extends along a rotation axis of the fixing member.

19. A fixing apparatus comprising
the fixing member according to claim 18,
wherein the fixing apparatus is adapted to fix a toner image onto the recording material.

* * * * *